US005898013A

United States Patent [19]

Mifune et al.

[11] Patent Number: 5,898,013

[45] Date of Patent: Apr. 27, 1999

[54] CATALYST SUPPORT MEMBER

[75] Inventors: Hideo Mifune; Masato Seki; Jun Kashiwagi, all of Shizuoka-ken, Japan

[73] Assignee: Tokai Corporation, Kanagawa-Ken, Japan

[21] Appl. No.: 08/722,804

[22] Filed: Sep. 27, 1996

[30] Foreign Application Priority Data

Sep. 28, 1995 [JP] Japan ..... 7-250333

[51] Int. Cl.[6] ..... B01J 23/00; F23Q 11/00

[52] U.S. Cl. ..... 502/300; 431/268

[58] Field of Search ..... 502/300, 349, 502/355, 66, 305; 125/16.02, 21; 451/532; 431/268; 428/389

[56] References Cited

U.S. PATENT DOCUMENTS 4,941,818 7/1990 Ohe et al. ..... 431/268

5,278,113 1/1994 Ono et al. ..... 502/66

FOREIGN PATENT DOCUMENTS 60-101419 6/1985 Japan .

*Primary Examiner*—Steven Bos

*Attorney, Agent, or Firm*—Baker & Botts, LLP

[57] ABSTRACT

A catalyst support member for a lighter and the like comprises a base made of heat-resistant material such as a nickel-chrome alloy wire or the like, and a mixed powder comprising a catalyst carrier and a strength maintaining material. The mixed powder is fusion bonded to the base with a vitreous powdered fusion bonding material. The catalyst carrier is essentially composed of metal oxide powder such as aluminum oxide powder, titanium oxide powder or the like. The strength maintaining material is essentially composed of a metal oxide powder, such as aluminum oxide powder, titanium oxide powder or the like, and has a diameter smaller than that of the catalyst carrier.

8 Claims, 7 Drawing Sheets

CATALYST SUPPORT MEMBER

BACKGROUND OF THE INVENTION

1. Field of the Invention

The present invention relates to a catalyst support member for a lighter for lighting up a cigarette or the like and for a torch burner used for heating processing, for re-lighting in combustion equipment, and for other purposes.

Such a lighter or torch burner as described above has been widely used. Many of such cigarette lighters in particular have been of flame combustion type wherein a liquefied gas is vaporized and released into the atmosphere through a nozzle and is burnt when secondary air is mixed, thereby forming a flame like a candle. In some cases, the flame is blown off by wind and goes off when the lighter is used outdoors. To overcome this problem, a catalyst lighter have been proposed in which a burner method allowing primary air to be mixed is employed and a catalyst component such as platinum or the like is disposed on a top end of a combustion cylinder. In the catalyst lighter of this kind, primary air is mixed with gas, inducing internal combustion within a combustion cylinder, and one part of the mixture of primary air and gas undergoes catalytic combustion and the other part is allowed to be mixed with secondary air insides and outside of the combustion cylinder, thus forming a flame to complete a burner combustion. Even if this flame coming from the burner combustion is blown off by wind, a heated catalyst component causes re-lighting due to the previous combustion, thus making a wind-resistant lighter which will not be blown off by wind and will not go out.

Thus, the present invention relates to a catalyst support member which can be substitute for conventional platinum wire and which is cost-competitive and has a high mechanical strength to suitably support a catalyst component to be used for a lighter or the like.

2. Description of the Prior Art

Japanese Unexamined Patent Publication No. 60(1985)-101419 discloses a conventional catalyst lighter wherein a catalyst member has been disposed in the vicinity of a fire outlet to allow re-lighting automatically, when a flame is blown off, without a need of an additional procedure of re-lighting, with the use of a catalyst whose temperature has been risen up to at least an ignition temperature.

It is so constructed that a coiled shape platinum wire whose temperature has risen is allowed to come into contact with fuel gas even after a flame has been blown off in order to be re-lighted.

However, such a lighter or torch burner using a platinum wire as a catalyst is high-priced because platinum itself is expensive and the catalyst alone constitutes much of manufacturing cost, increasing the total cost of the lighter. Therefore, a cost-competitive catalyst member instead of a platinum wire is required for manufacturing of such catalyst lighters and catalyst torch burners.

SUMMARY OF THE INVENTION

According to the present invention, the amount of a catalyst including platinum used is reduced by employing a basic construction for a catalyst member for re-lighting wherein a heat-resistant materials such as a nickel-chrome alloy wire is utilized as a base which is formed to be coiled-shaped and wherein powder of a metal oxide such as aluminum oxide, titanium oxide or the like is used as a catalyst carrier to which a vitreous powdered fusion bonding material is added to form a mixture, whereby the mixture is fusion bonded at a high temperature to the base, and wherein a chloroplatinic acid solution containing a catalytic component such as platinum is applied to the surface of the catalyst carrier bonded to the base with a fusion bonding material followed by being dried and decomposed thermally at a high temperature to deposit the catalytic component, such as platinum powder or the like, onto the surface of the catalyst carrier, thus forming a catalyst member which is installed on the lighter.

If the catalyst support member as mentioned above is used to form the catalyst member, it may be influenced by heat shock caused by lighting, shock by dropping during use of a lighter, mechanical vibration from a piezoelectric device caused by piezoelectric lighting or mechanical vibration caused by opening and closing of a cap in the case of a lighter with a cap. Therefore, the catalyst support member must be bonded firmly to the base so that the catalyst support member containing catalytic components is not dropped by various shocks as shown above.

In the catalyst support member to which a metal oxide powder is fusion bonded simply by using the fusion bonding material such as glass frit, there is a fear that a problem of durability, that is, for example, deterioration of the functions of the catalyst, which may result in no re-lighting, may be raised due to a shortage of bonding strength and due to peeling-off of catalytic components.

Thus, the object of the present invention is to provide a catalytic support member whose durability is improved by increasing bonding strength of the catalyst carrier to the base with the use of metal oxide powder.

A catalyst support member of the present invention comprises:

- a base made of heat-resistant material such as a nickel-chrome alloy wire or the like; and
- a mixed powder comprising a catalyst carrier essentially composed of metal oxide powder such as aluminum oxide powder, titanium oxide powder or the like, and a strength maintaining material essentially composed of a metal oxide powder, such as aluminum oxide powder, titanium oxide powder or the like, having a diameter smaller than that of said catalyst carrier,
- wherein the mixed powder is fusion bonded to the base with a vitreous powdered fusion bonding material.

The catalyst carrier may be essentially composed of aluminum oxide powder, and the strength maintaining material may be essentially composed of titanium oxide powder. Alternatively, aluminum oxide powder can be used for both the catalyst carrier and the strength maintaining material.

When aluminum oxide is used as the catalyst carrier, it is preferable for the powder of aluminum oxide to have a diameter falling within the range of 0.05 to 1 $\mu$m and a specific surface of 8 $m^2/g$ or more. When titanium oxide is used as the strength maintaining material, it is preferable for the powder of titanium oxide to have a diameter of 0.8 $\mu$m or less and preferably around 0.2 $\mu$m. When aluminum oxide is used as the strength maintaining material, it is preferable for the powder of aluminum oxide to have a diameter of 0.2 $\mu$m or less and preferably around 0.05 $\mu$m.

The catalyst support member is so constructed that mixed powder of the catalyst carrier having a larger particle diameter and the strength maintaining material having a smaller particle diameter is fusion bonded to the base of the catalyst support member, and the catalyst component, such as platinum, is deposited onto the surface of the catalyst carrier. The catalyst support member is disposed in the vicinity of a fire outlet of a lighter or the like. The catalyst component deposited onto the surface of the catalyst carrier exhibits the same catalytic reaction as in the case of a platinum wire, causing the lighter to be automatically re-lighted even after the flame has been blown off and goes out.

The catalyst carrier having a larger particle diameter can provide good and much supporting functions of catalyst components on its surface, allowing a desired re-lighting function by catalytic property.

The mixing of the catalyst carrier with the strength maintaining material having a diameter smaller than that of the catalyst carrier can reduce the space between the base and the catalyst carrier and between the catalyst carriers, thereby increasing contact areas as well as bonding strength, which leads to prevention from peeling-off of the catalyst carrier from the base caused by repeated heat shock and mechanical shock and to a long duration of re-lighting capability.

A greater amount of supported catalyst components, such as platinum, makes catalytic functions and capability of the catalyst member more stable. However, life characteristics of the catalyst member deteriorate as the supported catalytic components are separated from the catalyst carrier while being used and the catalyst carrier supporting catalytic components are peeled off. Therefore, the firm bonding of the catalyst carrier to the base and appropriate amount of catalytic components deposited onto the surface of the catalyst carrier are required in practical and actual applications for a lighter or the like accordingly.

From the viewpoint of the catalyst supporting capability and bonding strength, the particle diameter of the catalyst carrier essentially composed of aluminum oxide falls preferably within the range of 0.05 to 1 $\mu$m, more preferably around 0.3 $\mu$m, and if its diameter is smaller, the catalyst supporting characteristics are deteriorated and if its diameter is larger, the bonding strength is reduced. Moreover, the catalyst carrier essentially composed of aluminum oxide having a specific surface of 8 $m^2/g$ or more can provide better catalyst supporting characteristics.

As is described above, a vitreous powdered fusion bonding material is used to fusion bond the catalyst carrier to the base. The bonding strength is increased by mixing the strength maintaining material essentially composed of metal oxide powder having a small particle diameter with the bonding material, which is, however, influenced by the particle diameter of the strength maintaining material to be mixed. Better results are obtained from the strength maintaining material having a small particle diameter. For example, the results obtained with titanium oxide having a diameter of 0.2 $\mu$m are better than those with titanium oxide having a diameter of 0.6 to 0.8 $\mu$m. Alternatively, titanium oxide having a diameter of 0.8 $\mu$m or less is applicable. The results obtained with aluminum oxide having a diameter of 0.05 $\mu$m are better than those with aluminum oxide having a diameter of 0.22 $\mu$m. Nevertheless, aluminum oxide having a diameter of 0.2 $\mu$m or less is applicable.

According to the present invention, by fusion bonding a mixed powder of the catalyst carrier having a large diameter with the strength maintaining material having a smaller diameter to the surface of the base, using a vitreous powdered fusion bonding material, by firmly fixing the catalyst carrier to ensure a better durability and to provide an excellent catalyst supporting capability, the catalyst support member is available which can achieve the same catalytic combustion as in the case where a platinum wire is used, providing good re-lighting functions even if a flame has been blown off, reducing the amount of expensive platinum used to a minimum level, giving an advantage in terms of costs and of high-effective catalytic functions.

BRIEF DESCRIPTION OF THE DRAWINGS

FIGS. 7A, 73 and 7C are graphs showing the results obtained with Experimental Example 5.

DESCRIPTION OF THE PREFERRED EMBODIMENT

The present invention will be hereinbelow be described in further detail with reference to the accompanying drawings.

Figure 1:
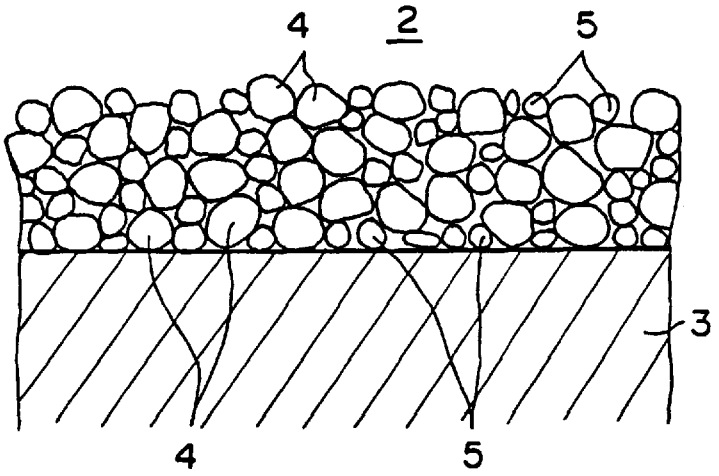
FIG. 1 is an enlarged sectional view illustrating a fundamental structure of a catalyst support member in one of the embodiments of the present invention.

FIG. 1 is an enlarged sectional view of an embodiment of the catalyst support member in accordance with the present invention. A catalyst support member 2 comprises a base 3 made of a heat-resistant material, such as a nickel-chrome alloy wire (hereinbelow often referred to as a nichrome wire) to the outer surface of which a catalyst carrier 4 made of powdered metal oxide is fusion bonded and secured by a vitreous powdered fusion bonding material (glass frit) together with a strength maintaining material 5 also made of powdered metal oxide with a particle diameter smaller than that of the catalyst carrier 4. Both the catalyst carrier 4 and the strength maintaining material 5 are essentially composed of a metal oxide such as powdered aluminum oxide, titanium oxide, etc., each having a different particle diameter, and a catalyst such as platinum or the like is deposited onto the surface of the catalyst carrier 4, thus forming a catalyst member 1 (a catalytic wire) which is described later.

The catalyst support member 2 is produced in such a manner that the catalyst carrier 4 and the strength maintaining material 5, which are essentially composed of powdered metal oxides having different particle diameters, are mixed together with which the vitreous powdered fusion bonding material is also mixed further and then the resulting mixed powder is deposited onto the surface of the base 3 and is heated, thereby allowing a firm fusion bonding of the catalyst carrier 4 and the strength maintaining material 5 to the base 3.

The catalyst member 1 is obtained by applying a catalytic solution, such as a solution of platinum compound, on the surface of the catalyst carrier 4 of the catalyst support member 2 followed by thermal decomposition to have the catalyst, such as platinum particles, deposited on the catalyst carrier 4. As a result of the above processings, the catalyst is also deposited on the strength maintaining material 5 accordingly.

The catalyst component to be supported on the catalyst support member 2 may be, in lieu of platinum, palladium, which is cheaper or rhodium, which has a high, catalytic efficiency, or the like. In such cases, as the catalyst solution, for example, a basic aqueous solution of palladium, rhodium, or the like, is used. A plurality of catalysts may also be used in combination.

More concrete examples of the catalyst support member for a lighter are described with reference to evaluation test.

Figure 2A:
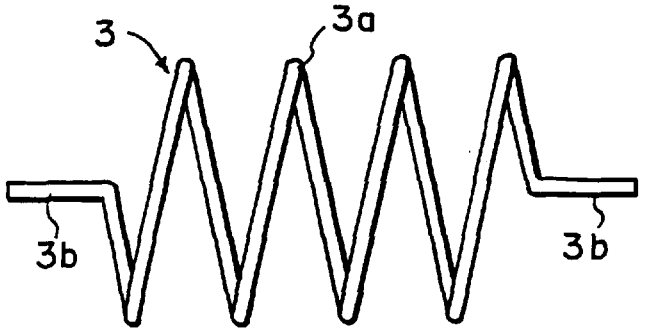
FIGS. 2A and 2B are front views showing the configurations of the base and the catalyst member.

In the catalyst support member 2, a linear base 3 having a coiled shape as illustrated in FIG. 2A was employed. The linear base 3 comprises a nichrome wire (the ratio of composition of nickel to chrome being 80:20) having a diameter of 0.15 mm (approximately 40 mm in length) and contains a coiled portion 3*a* with an external diameter of 2.7 mm which is coiled four turns at a pitch of 1.0 mm and fitting portions 3*b* having a length of 1 mm extended from the opposite ends of the coiled portion.

Aluminum oxide powder was used as a material for the catalyst carrier 4, and various aluminum oxide powders produced by a variety of manufacturing methods each having a different particle size forming its different surface states were selected for experiments. A variety of powders of titanium oxide and aluminum oxide were also selected as the strength maintaining material 5 to ensure a firm baking of the catalyst carrier 4 on the base 3.

The catalyst support material 4 and the strength maintaining material 5 were mixed at different mixing ratios. The resulting mixtures having different mixing ratios were further mixed with glass frit, used as a fusion bonding material, at different mixing ratios as well. The glass frit comprises $SiO_2$ (80.9%), $B_2O_3$ (12.7%), $Na_2O$ (4.0%), $Al_2O_3$ (2.3%), $K_2O$ (0.04%) and $Fe_2O_3$ (0.03%).

Figure 2B:
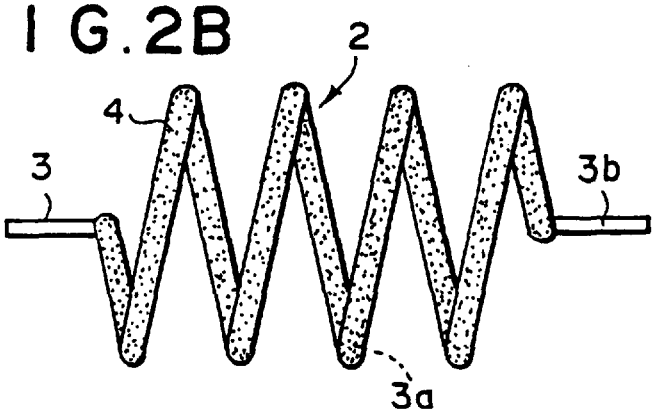

A 3% aqueous solution of polyvinyl alcohol was added to the mixed powders to make the mixtures tacky, and 3 mg of the tacky mixtures were applied to a coil portion 3*a* of base 3 and, after being dried at a normal temperature, were heated at a temperature of 300° C. for 15 minutes. Then, the polyvinyl alcohol is thermally decomposed and then removed. The remaining mixtures were heated at 1240° C. for 10 minutes, whereby the catalyst carrier 4 and the strength maintaining material 5 were fusion bonded together with the glass frit to form the catalyst support member 2 as illustrated in FIG. 2B.

The catalyst support member 2 was soaked in a 0.1% solution of platinum chloride acid which was used as a catalytic solution and, after being dried, was thermally decomposed at a temperature of 800° C. for 10 minutes so that platinum powders were deposited on the surface of the catalyst carrier 4.

A variety of catalyst members 1 made with the mixing ratio and the compositions being changed were disposed at the upper near end of a combustion cylinder 18 of a gas lighter 10 and located in flames in an internal combustion state. The mechanical strength and the catalytic efficiency of the catalyst member practically required for a lighter or torch burner were evaluated.

The evaluation tests of the catalyst member 1 included a drop impact test, a bending strength test, a bonding strength test, a test for a catalyst reaction appearing when the catalyst member was actually installed on the lighter, a re-lighting test and a test for durability obtained with 1000 times re-lighting. The concrete method and the results of each test are described later.

An example of a structure of the catalyst member 1 to be installed on the lighter 10 is shown. As described above, the catalyst support member 2 was obtained by mixing aluminum oxide powder (crystal γ) with a particle diameter of 0.3 μm as a catalyst carrier 4 with aluminum oxide powder (crystal γ) with a particle diameter of 0.05 μm as a strength maintaining material 5 and with glass frit at mixing rates of 64%, 32% and 4% by weight, respectively and by applying, to the base 3 which is made by coiling a nichrome wire having a wire diameter of 0.15 mm (with external diameter of the coil being 2.7 mm, pitch being 1.0 mm, number of turns being 4), about 3 mg of a tacky mixture produced by adding polyvinyl alcohol to the resulting mixture, by drying at a normal temperature, by heating at a temperature of 300° C. for 15 minutes to remove the polyvinyl alcohol and further by heating at a temperature of 1240° C. for 10 minute to achieve fusion bonding.

The catalyst member 1 was obtained by soaking the catalyst member 2 in a 0.1% solution of platinum chloride acid, by heating at a temperature of 800° C. for 10 minutes and by carrying out four times thermal decomposition to have platinum deposited onto the surface of the catalyst support member 2.

The catalyst support member 2 was obtained by mixing aluminum oxide powder (crystal α) with a particle diameter of 0.3 μm as a catalyst carrier 4 with titanium oxide powder (crystal γ) having a particle diameter of 0.2 μm as a strength maintaining material 5 and with glass frit at a mixing rate of 64%, 32% and 4% by weight, respectively and by applying, to the base 3 which is made by coiling a nichrome wire with a wire diameter of 0.15 mm (with external diameter of the coil being 2.7 mm, pitch being 1.0 mm, number of turns being 4), about 3 mg of a tacky mixture produced by adding polyvinyl alcohol to the resulting mixture, by drying at a normal temperature, by heating at a temperature of 300° C. for 15 minutes to remove the polyvinyl alcohol and further by heating at a temperature of 1240° C. for 10 minute to achieve fusion bonding. The catalyst member 1 is also obtained by having platinum deposited on the catalyst support member 2 in the same manner as above.

The desired catalytic lighter was fabricated by fixing each of the catalyst members 1 to the upper end of a combustion tube of the lighter 10 and by setting the gas at 30 cc/min.

Figure 3:
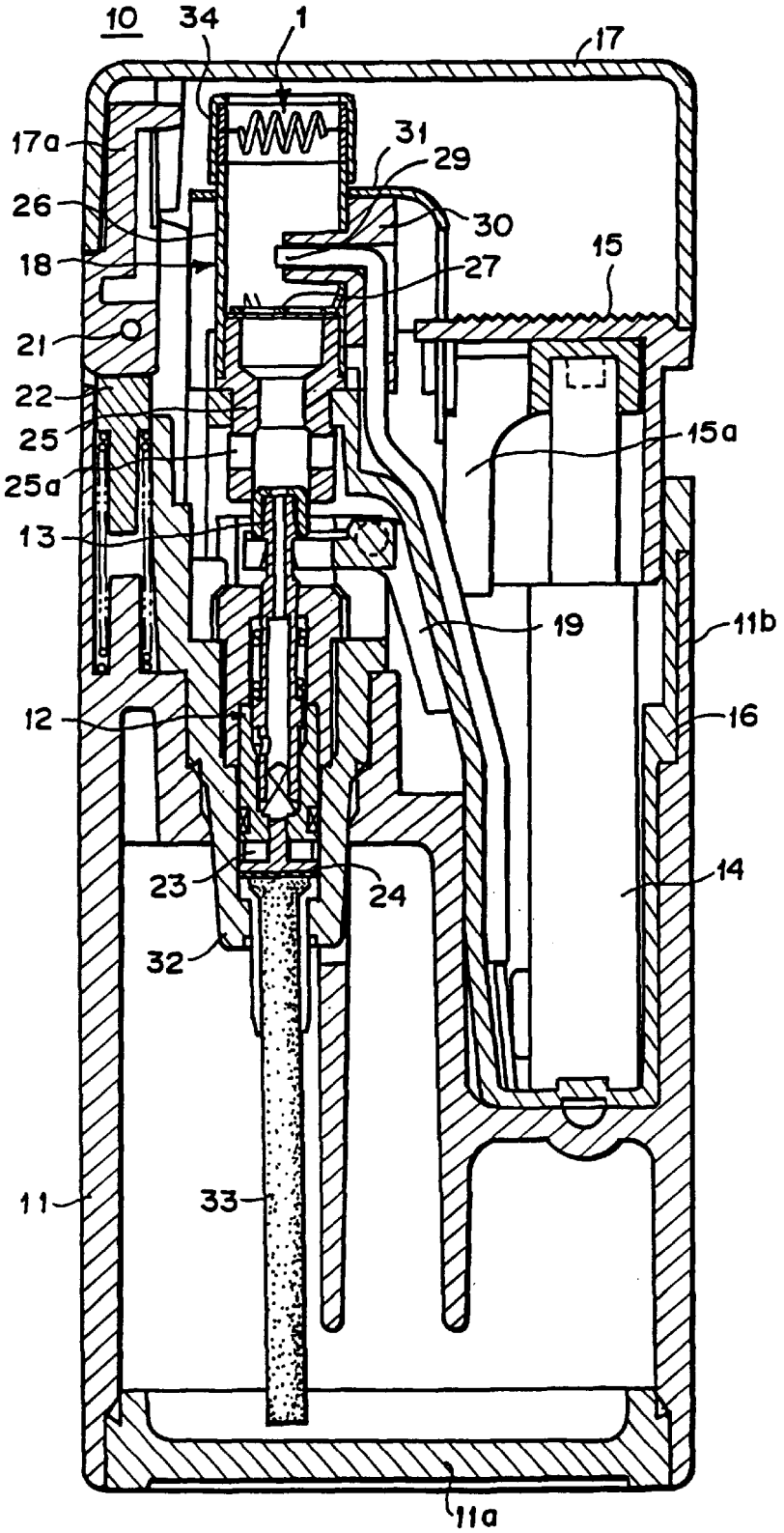
FIG. 3 is a longitudinal sectional view of a lighter having the catalyst member comprising the catalyst support member of the present invention.
Figure 4:
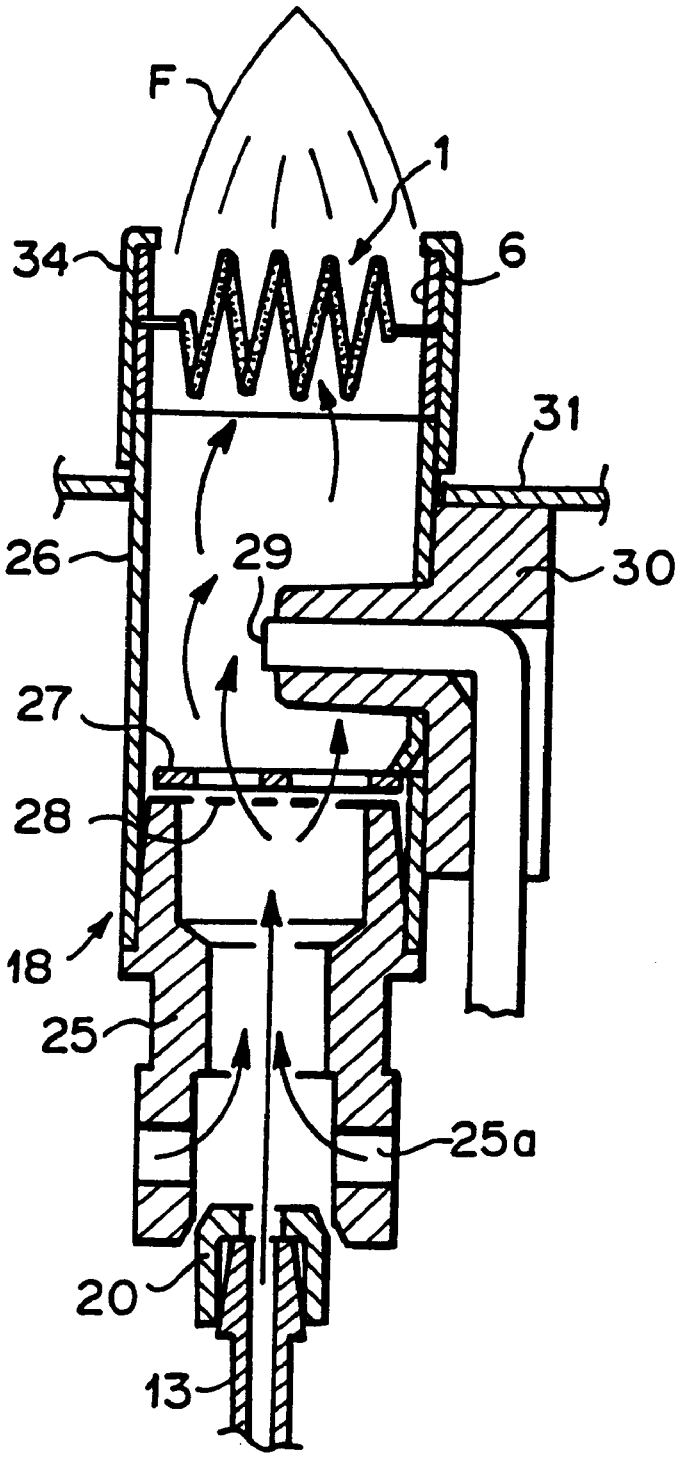
FIG. 4 is an enlarged sectional view showing the main parts of the lighter shown in FIG. 3.

FIG. 3 is a longitudinal sectional view of a lighter having the catalyst members 1 and FIG. 4 is an enlarged sectional view showing a structure of the combustion cylinder.

The gas lighter is provided with a tank main body 11 storing fuel gas at its lower part. The tank main body 11 is made of a synthetic resin to the bottom of which a bottom cover 11*a* is connected and on the upper circumferential face of which a side-wall portion 11*b* is integrally molded and which stores a high-pressure fuel gas such as isobutane gas.

On the upper end of said tank main body 11, a valve mechanism 12 having a nozzle 13 from which the fuel gas is jetted is attached which is contained in a valve housing 32. On the upward part of said nozzle 13, a combustion cylinder 18 to burn the fuel gas jetted from said nozzle 13 is provided. The burning of the fuel gas within the combustion cylinder is performed by a primary air mixing combustion method wherein the primary air is taken in and mixed.

At the side of said valve mechanism 12, piezoelectric unit 14 is disposed, on the upper end of which an operating member 15 which controls the valve mechanism 12 to cause the fuel gas to be jetted and controls the piezoelectric unit 14 to cause ignition. The piezoelectric unit 14, the operating member 15 and the combustion cylinder 18 are all supported by an internal housing 16 and installed within the tank main body is. A push-pull type cover 17 used to open and close the upper part of the combustion cylinder 18 and the operating member 15 is provided. A supporting member 17*a* is attached to the cover 17, which is connected to the tank main body 11 via a pin 21. A pushing member 22 being in contact with two faces of the supporting member 17*a* is disposed on the upward part of the supporting member 17*a*, which is used to maintain open and closed positions of the supporting member 17*a*.

The valve mechanism 12 is used to jet gas from the tip of the nozzle having a gas path by moving the nozzle 13 in the upward direction to a part of which a L-shaped actuating lever 19 is connected. The center part of the actuating lever 19 is supported to allow it to be rotated freely by a contact of another end of the actuating lever 19 with a lever push 15*a* attached to the operating member 15, which initiates and stops the jetting of gas controlled by the nozzle 13.

A nozzle 20 (see FIG. 4) having a slot with a specified diameter (for example, 50 $\mu$m) is mounted on the end of the nozzle 13 which is fitted into the bottom of the combustion/cylinder 18 into which gas is jetted at a high speed.

Moreover, the valve mechanism 12 is equipped with a gas flow adjusting filter 23 used to adjust the amount of jetted fuel gas regulated to an approximately constant amount relative to changes in various temperatures. The gas flow adjusting filter 23 is installed at the bottom of the valve mechanism 12 in a compressed state by a nail-shaped stator. The liquefied gas transferred through a porous core 33 from the tank is directed to the center of the filter from its circumferential part in the radial direction and vaporized.

The microstructure of the filter 23 is composed of a micro cell polymer foaming substance having bubbles used as a gas path communicating with each other through fine holes at contacting points and closed cells adapted to compress or expand the gas flow path by swelling and contraction with changes in temperatures, thus allowing gas flow to be automatically adjusted relative to changes in temperatures.

Furthermore, as shown in FIG. 4, the combustion cylinder 18 comprises a base 25 disposed at its base location, and a combustion tube 26 connected directly to the base 25 which extends upwardly. The gas path passes through the center part of the base 25 into the lower end of which the tip of the nozzle 13 is fitted. The primary air slot 25*a* disposed at both sides of the nozzle and passing through in the radial direction opens toward the lower end of the nozzle. On the upper end of the base 25, an eddy flow plate 27 and a metal mesh member 28 are mounted. The eddy flow plate 27 opens into the metal circular plate which produces eddy flow in the gas flow, thus facilitating mixing of fuel gas with primary air. The metal mesh member 28 is composed of a circular wire gauze 9 which is used to inhibit a back flow of flame.

The operating member 15 is supported by the piezoelectric unit 14 for a downward sliding movement. On the side of the operating member 15, a discharge electrode 29 connected to the piezoelectric unit is disposed inwardly and supported by an electrode holder 30 passing through the side face of the combustion tube 26 of the combustion cylinder 18.

The upper circumferential part of the primary air slot 25*a* of the base 25 within the combustion cylinder 18 is engaged with the internal housing 16 and supported together with the combustion tube 26 to which the electrode 29 and electrode holder 30 are attached, at the outside of which a cover 31 is disposed and the combustion cylinder 18 is fixed, thus forming an assembled component including the piezoelectric unit 14 and the operating member 15 covered by the internal housing which is, as a whole, attached to the tank main body 11, thus achieving a simple assembly of the lighter.

At the near upper end of the combustion tube 26 of the combustion cylinder, the catalyst member 1 is disposed. The fitting portion 3*b* extending to both ends of the coil portion 3*a* of the catalyst member 1 is secured to an annular body having the same shape as the combustion tube 26, facing in the radial direction. The annular body 6 is mounted on the upper end of the combustion tube 26, in the circumferential portion of which a cap 34 is provided. The catalyst member 1 is installed in the aperture of the fire outlet portion of the upper end of the combustion tube 26.

The gas lighter 10 described above is so constructed that, when the operating member 15 is pushed down, its lever push 15*a* causes the actuating lever 19 to rotate and raise the nozzle 13, thereby allowing fuel gas to be jetted. The negative pressure produced by the flow speed and the flow rate of the gas jetting from the nozzle 13 causes the primary air to be taken into from the primary air hole 25*a* which opens to the side and to be mixed with the jetted gas. The resulting mixture, after passing through the mesh member 28 for preventing a back flow of the flame, is also agitated and mixed again by the eddy flow plate 27 and goes up through the combustion tube 26.

Pushing further down the operating member 15 activates the piezoelectric unit 14 to supply a high voltage for discharging to the electrode 29, thus allowing the mixed gas to be lighted and a part of the flame to come out within the upper end of the combustion tube 18. The high temperature position of the flame F is determined by a mixing ratio of the primary air and the gas as well as the flow speed of the mixed gas and the catalyst member 1 is so disposed that it is located at the high temperature portion of the flame F accordingly.

The flame F passes through the catalyst member 1. when the catalyst member 1 disposed on the upper end of the combustion cylinder 18 is in contact with the high temperature portion of the flame F, its catalytic component is heated rapidly to a high temperature which is in the level for the catalytic reaction or higher, and the flame comes into a red heat state. Even if the flame goes off by a wind, because the catalyst member 1 is heated up to equal to or more than a temperature required as a catalytic reaction temperature (about 600° C.) for burning of the mixed gas by oxidation, the mixed gas can be re-lighted by the catalyst member 1 without any procedure of re-lighting and its burning is continued. In an ordinary use state, because the operating member 15 is continuously operated during lighting, fuel gas is always blown to the catalyst member 1, forming the flame F continuously.

Moreover, when the jetting of fuel gas is stopped and the flame is extinguished by releasing the operating member 15, because the heat capacity of the catalyst member 1 is not so large, its temperature is lowered down very rapidly and the fuel gas that has leaked is not lighted.

Though the base 3 of a coil-shaped configuration is shown in the embodiments described above, modifications can be made so that, for example, any required number of bar-shaped bases can be disposed in parallel or the base wherein a part that is in contact with flame is wave-shaped can be used.

EXPERIMENTAL EXAMPLE 1

To obtain particle diameter characteristics of the catalyst carrier 4 ($Al_2O_3$) and the strength maintaining material 5 ($TiO_2$), an experiment was carried out. Table 1 shows the results. Test methods are described later.

The catalyst carrier 4 made of aluminum oxide powder having a particle diameter of 0.05 $\mu$m, 0.3 $\mu$m or 1.0 $\mu$m, the strength maintaining material 5 made of titanium oxide powder having a particle diameter falling within the range of 0.2 μm and 0.6 to 0.8 μm were selected, and various combinations of these were used for the texts. The mixing ratio was 64% by weight for the catalyst carrier (aluminum oxide), 32% by weight for the strength maintaining material (titanium oxide) and 4% by weight for the glass frit. The number of times of baking and thermal decomposition of platinum chloride acid was four.

Best results in each test were obtained from the embodiment using the catalyst carrier 4 composed of aluminum oxide with a particle diameter of 0.3 μm and the strength maintaining material 5 composed of titanium oxide with a particle diameter of 0.2 μm.

EXPERIMENTAL EXAMPLE 2

This experiment was carried out to obtain specific surface characteristics of the catalyst carrier 4 ($Al_2O_3$). Table 2 shows the results in combination with the strength maintaining material 5 ($TiO_2$).

The catalyst carrier 4 composed of aluminum oxide having a specific surface of 8.9 $m^2/g$ or 15.3 $m^2/g$, and having a particle diameter of 0.3 μm was used for comparison in the experiment.

Better results were obtained from the catalyst carrier 4 comprising aluminum oxide having a larger specific surface.

EXPERIMENTAL EXAMPLE 3

This experiment was carried out to obtain particle diameter characteristics of the catalyst carrier 4 ($Al_2O_3$) and the strength maintaining material 5 ($Al_2O_3$). Table 3 shows the results.

The catalyst carriers 4 composed of aluminum oxide having a particle diameter of 0.05 μm. 0.3 μm or 1.0 μm, and the strength maintaining material 5 having a particle diameter of 0.05 μm or 0.22 μm were used for the experiment.

Better results were obtained from the samples using the catalyst carrier 4 composed of aluminum oxide with a particle diameter of 0.3 μm, and the best results were obtained from the samples using the strength maintaining material composed of aluminum oxide with a particle diameter of 0.05 μm.

EXPERIMENTAL EXAMPLE 4

This experiment was carried out to obtain specific surface characteristics of the catalyst carrier 4 ($Al_2O_3$). Table 4 shows the results in combination with the strength maintaining material 5 ($Al_2O_3$).

The catalyst carrier 4 composed of aluminum oxide having a specific surface of 8.9 $m^2/g$ or 15.3 $m^2/g$ as in the case of experimental example 2 was used. In this case, materials are the same being aluminum oxide.

Better results were obtained from the samples using the catalyst carrier 4 composed of aluminum oxide with a larger specific surface.

EXPERIMENTAL EXAMPLE 5

Figure 7A:
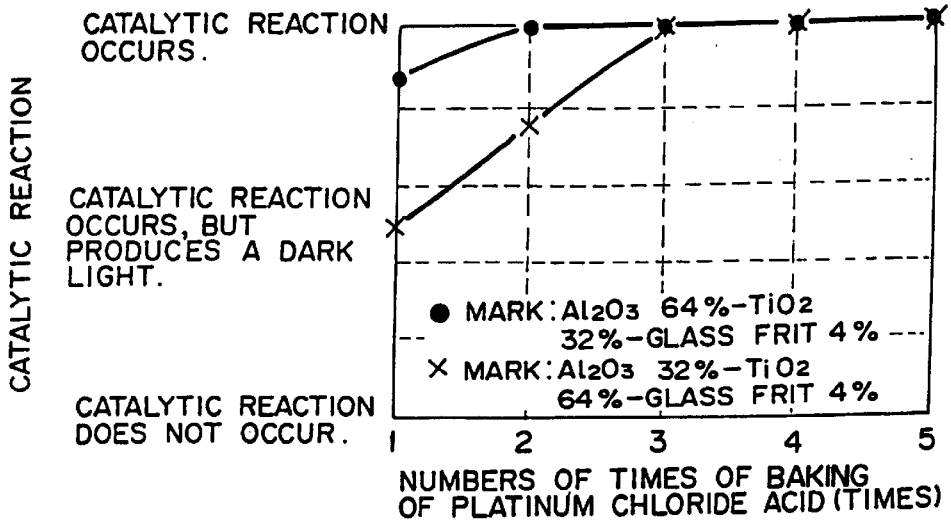
Figure 7B:
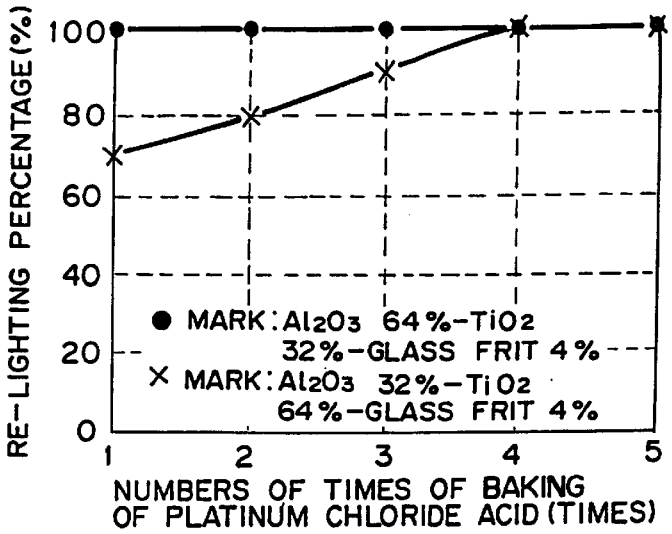
Figure 7C:
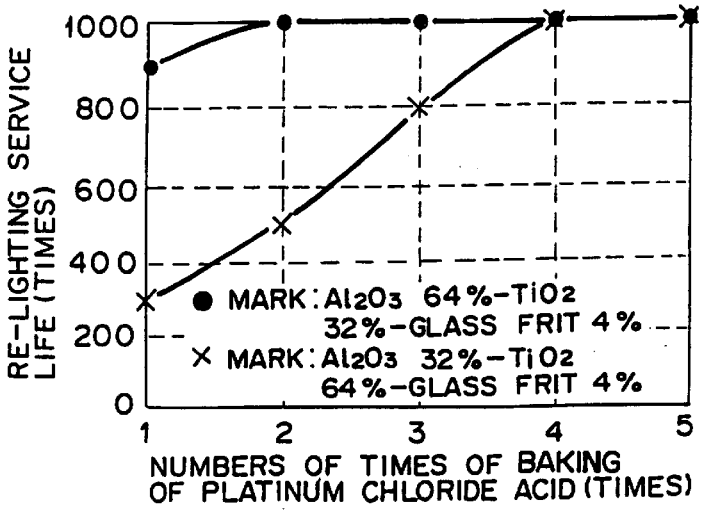

This experiment was carried out to obtain various characteristics of samples to determine the effects of the number of times of baking of platinum chloride acid relative to the mixing ratio, using a combination of the catalyst carrier 4 ($Al_2O_3$) and the strength maintaining material 5 ($TiO_2$). FIG. 7 shows the results.

The catalyst carrier 4 composed of aluminum oxide with a larger specific surface of 0.3 μm and the strength maintaining material 5 composed of titanium oxide with a particle diameter of 0.2 μm were used. The latter was mixed with the former by changing a mixing ratio of 64% by weight for the former and 32% by weight for the latter or 32% by weight for the former and 64% by weight for the latter. The glass frit in an amount of 4% by weight was mixed with these two materials.

Better results for the catalytic reaction, re-lighting percentage and re-lighting durability were obtained from the samples using the catalyst carrier 4 with two or more times of baking in the case of a larger mixing ratio for aluminum oxide or with four times or more of baking in the case of a smaller mixing ratio for aluminum oxide, and the samples with a larger mixing ratio for aluminum oxide in the cases where the number of times of baking is the same.

EXPERIMENTAL EXAMPLE 6

Figure 8A:
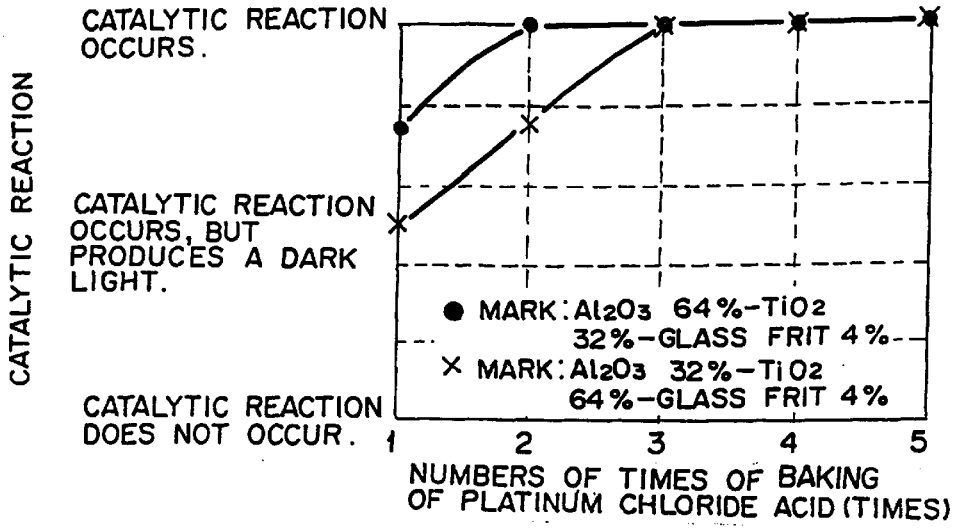
FIGS. 8A, 8B and 8C are graphs showing the results obtained with Experimental Example 6.
Figure 8B:
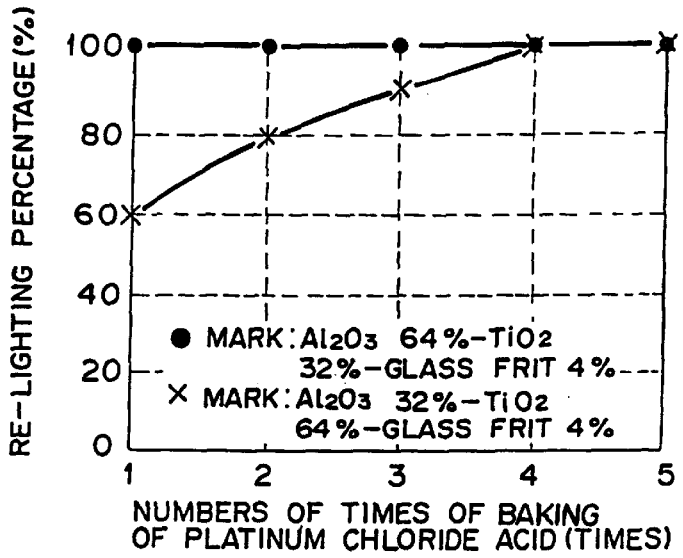
Figure 8C:
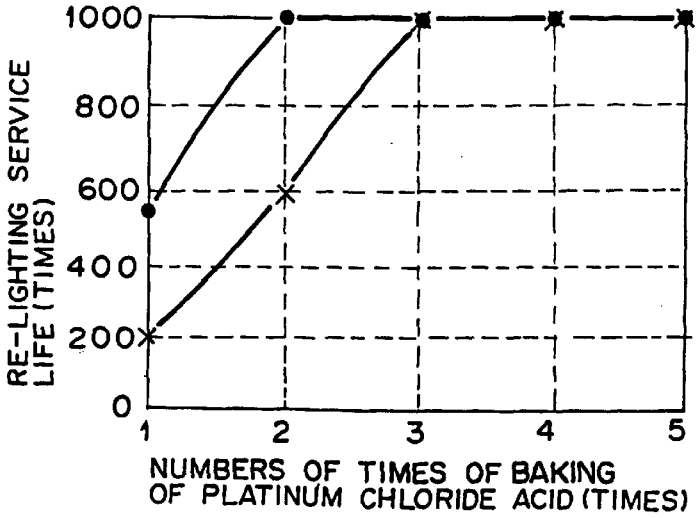

This experiment was carried out to obtain various characteristics of samples to determine the effects of the number of times of baking of platinum chloride acid relative to the mixing ratio, using a combination of the catalyst carrier 4 ($Al_2O_3$) and the strength maintaining material 5 ($Al_2O_3$). FIG. 8 shows the results.

Aluminum oxide having a smaller particle diameter of 0.05 μm, instead of the titanium oxide, was used as the strength maintaining material 5. The same mixing ratios as for Experimental Example 5 were employed. The same tendencies as in the above Experiment were observed wherein better results were obtained from the samples containing larger amounts of the catalyst carrier 4.

TABLE 1

| Particle Diameter of Strength Maintaining | Particle Diameter of Catalyst carrier $Al_2O_3$ | | |
|---|---|---|---|
| Material $TiO_2$ | 0.05 μm | 0.3 μm | 1.0 μm |
| (A) Drop Impact Test (Amounts peeled off by ten times drop) [mg] | | | |
| 0.2 μm | 0.00 | 0.00 | 0.28 |
| 0.6~0.8 μm | 0.00 | 0.00 | 0.90 |
| (B) Bonding Strength Test (Amounts peeled off) [mg] | | | |
| 0.2 μm | 0.00 | 0.00 | 0.62 |
| 0.6~0.8 μm | 0.08 | 0.20 | 1.48 |
| (C) Re-lighting Service Life (Number of pieces having no re-lighting out of 20) (pieces) | | | |
| 0.2 μm | 3/20 | 0/20 | not re-lighted |
| 0.6~0.8 μm | 0/20 | 0/20 | not re-lighted |
| (D) Re-lighting Time (initial value) (seconds) | | | |
| 0.2 μm | 2.98 | 2.76 | not re-lighted |
| 0.6~0.8 μm | 2.64 | 2.43 | not re-lighted |

TABLE 2

| Particle Diameter of Strength Maintaining | Specific Surface (0.3 μM) of Catalyst carrier $Al_2O_3$ | |
|---|---|---|
| Material $TiO_2$ | 8.9 $m^2/g$ | 15.3 $m^2/g$ |
| (A) Drop Impact Test (Amounts peeled off by ten times drop) [mg] | | |
| 0.2 μm | 0.31 | 0.00 |
| 0.6~0.8 μm | 0.44 | 0.65 |
| (B) Bonding Strength Test (Amounts peeled off) [mg] | | |
| 0.2 μm | 0.10 | 0.00 |
| 0.6~0.8 μm | 0.36 | 0.20 |

TABLE 2-continued

| Particle Diameter of Strength Maintaining | Specific Surface (0.3 μM) of Catalyst carrier $Al_2O_3$ | |
|---|---|---|
| Material $TiO_2$ | 8.9 $m^2/g$ | 15.3 $m^2/g$ |
| (C) Re-lighting Service Life (Number of pieces having no re-lighting out of 20) (pieces) | | |
| 0.2 μm | 0/20 | 0/20 |
| 0.6~0.8 μm | 3/20 | 0/20 |
| (D) Re-lighting Time (initial value) (seconds) | | |
| 0.2 μm | 3.74 | 2.76 |
| 0.6~0.8 μm | 3.86 | 2.43 |

TABLE 3

| Particle Diameter of Strength Maintaining | Particle Diameter of Catalyst carrier $Al_2O_3$ | | |
|---|---|---|---|
| Material $TiO_2$ | 0.05 μm | 0.3 μm | 1.0 μm |
| (A) Drop Impact Test (Amounts peeled off by ten times drop) [mg] | | | |
| 0.05 μm | 0.00 | 0.00 | 2.85 |
| 0.22 μm | 0.11 | 1.80 | 2.65 |
| (B) Bonding Strength Test (Amounts peeled off) [mg] | | | |
| 0.05 μm | 0.00 | 0.00 | 2.64 |
| 0.22 μm | 0.06 | 1.78 | 2.74 |
| (C) Re-lighting Service Life (Number of pieces having no re-lighting out of 20) (pieces) | | | |
| 0.05 μm | 3/20 | 0/20 | 12/20 |
| 0.22 μm | 6/20 | 3/20 | 12/20 |
| (D) Re-lighting Time (initial value) (seconds) | | | |
| 0.05 μm | 2.69 | 2.10 | 3.34 |
| 0.22 μm | 2.48 | 2.57 | 3.70 |

TABLE 4

| Particle Diameter of Strength Maintaining | Specific Surface (0.3 μM) of Catalyst carrier $Al_2O_3$ | |
|---|---|---|
| Material $TiO_2$ | 8.9 $m^2/g$ | 15.3 $m^2/g$ |
| (A) Drop Impact Test (Amounts peeled off by ten times drop) [mg] | | |
| 0.05 μm | 0.73 | 0.00 |
| 0.22 μm | 1.06 | 1.80 |
| (B) Bonding Strength Test (Amounts peeled off) [mg] | | |
| 0.05 μm | 0.02 | 0.00 |
| 0.22 μm | 0.28 | 1.78 |
| (C) Re-lighting Service Life (Number of pieces having no re-lighting out of 20) (pieces) | | |
| 0.05 μm | 9/20 | 0/20 |
| 0.22 μm | 15/20 | 3/20 |
| (D) Re-lighting Time (initial value) (seconds) | | |
| 0.05 μm | 3.52 | 2.10 |
| 0.22 μm | 4.06 | 2.57 |

Drop Impact Test

Figure 5:
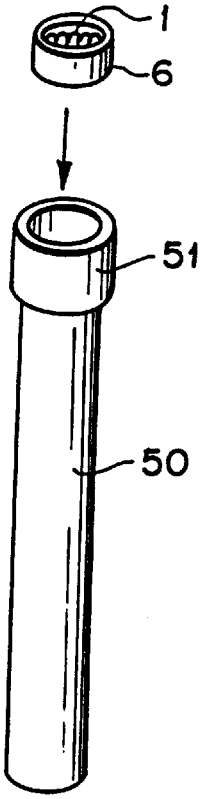
FIG. 5 is a perspective view of a jig to be used for drop impact test.

Each of the samples (obtained by fixing the catalyst member 1 to the annular body 6) of the catalyst member 1 formed by the above-mentioned methods was attached to a jig So for the drop impact test as shown in FIG. 5. A supporting portion 51 was provided at one end part of the jig 50. The sample (annular body 6) was inserted and fixed within the supporting portion 51. In the drop test, the jig 50 was dropped from a height of 1.5 m onto a concrete block with the sample attaching side facing down. The sample was attached to the lighter every time of dropping. After repeating ten times these steps of lighting for one second, a shock was given. The weight (mg) of the catalyst member 1 peeled off by ten times dropping was measured. The more amounts peeled off were, the more vulnerable the catalyst member was to shock.

Bonding Strength Test

Figure 6A:
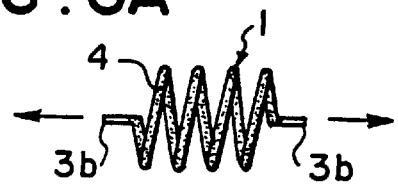
FIGS. 6A and 6B are an explanatory views of a bonding strength test.
Figure 6B:
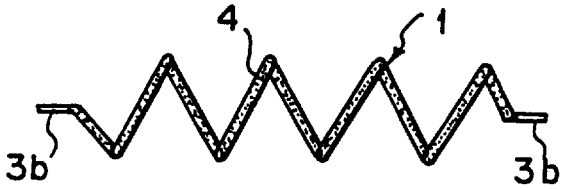

Samples of the coil-shaped catalyst member 1 were used in the experiment as well. As shown in FIG. 6, the coiled part of the sample with a length of 4 mm was extended up to a length of 16 mm as shown in 63, and the weight (mg) of the catalyst member 1 which had been peeled off during the extension was measured. The more amounts peeled off were, the lower the bonding strength was.

Catalytic Reaction and Re-lighting Test

Lighters provided with the various samples were ignited and then extinguished one second later, and only gas was allowed to be jetted, thereby causing a catalytic reaction. The data concerning the catalytic reactions were obtained by visually observing the catalytic reactivity and dividing the reactions into group 1 wherein a reaction occurred, turning to a heated state in red color or group 2 wherein a reaction occurred, generating darker light or group 3 wherein no reaction occurred.

The re-lighting test was performed in such a manner that the lighter was ignited and extinguished one second later, and then only gas was allowed to be jetted, and the time period up to the time when a fire was lighted again due to the catalytic reactions occurring and the catalytic reaction heat from the catalytic reactions and a flame was formed was measured.

The re-lighting percentage was evaluated and classified as follows: If a flame was formed within 3 seconds, it was judged as "being re-lighted". If re-lighting occurred 10 times out of consecutive ten repeated trials, it was defined as "being re-lighted". If no re-lighting occurred at least one time out of consecutive ten repeated trials, it was defined as "being sometimes relighted". If no re-lighting occurred at all the time or if it took 3 seconds or more to be re-lighted even in the case of occurrence of re-lighting, it was defined as "not being re-lighted". The re-lighting percentage was represented as a percentage obtained by dividing the number of times of re-lighting by 10.

Re-lighting Service Life Test

Lighters provided with the various samples in the same manner as above were lighted and allowed to burn for about 1 second and were then extinguished. These steps were repeated 1,000 times. During this process, whether re-lighting occurred or not was confirmed for every 50 times. If re-lighting stopped, the number of times of re-lighting which had occurred until then was recorded.

According to Domestic Products Safety Standards of Association of products safety regulating a drop test (impact resistance test) of a lighter, a lighter should be free of dangerous breakage or continuous burning by igniting when a lighter is naturally dropped from a height of 1.5 m with its bottom facing upward, downward and horizontally, respectively. The tests using the lighter fabricated according to the present invention were performed. The results showed that there was neither functional abnormality nor peeling-off of supporting members from the catalyst member, confirming that the catalyst member used in the lighter normally functioned.

A disposable gas lighter usually runs out of gas after it is lighted about 600 times. However, it has been confirmed from experiments that the catalyst member installed in the lighter of the present invention will not deteriorate even after it is lighted 1000 times, maintaining its function.

Figure 9:
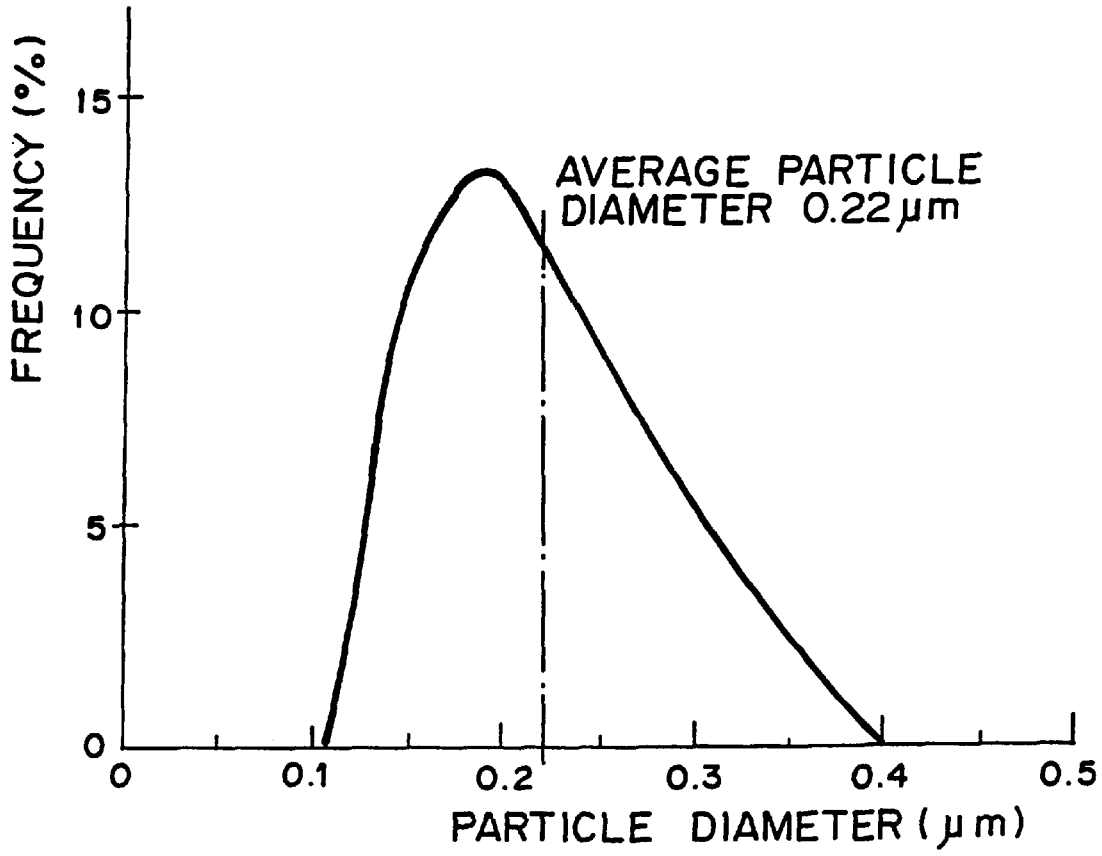
FIG. 9 is a graph showing an example of the particle size distribution of aluminum oxide powder.

The particle diameter values of the metal oxide powders used in the present invention as shown herein represent average particle diameters. There is usually no metal oxide powders with a single unified particle diameter. Practically, it is a mixture of powders with various particle diameters. For example, if aluminum oxide powder is reported to have an average particle diameter of 0.22 $\mu$m, it means that the aluminum oxide powder has particle diameters ranging from about 0.1 $\mu$m to about 0.4 $\mu$m as shown in a particle size distribution diagram of FIG. 9.

What is claimed is:

1. A catalyst support member comprising:

a base member made of heat-resistant alloy wire; and a mixed powder comprising a catalyst carrier meatal oxide powder, and a strength maintaining metal oxide powder having powder particles with an average diameter smaller than the average diameter of said catalyst carrier metal oxide powder, said mixed powder being fusion bonded to said base member with a vitreous powdered fusion bonding material.

2. The catalyst support member as defined in claim 1 wherein said catalyst carrier metal oxide powder is aluminum oxide powder and said strength maintaining metal oxide powder is titanium oxide powder.

3. The catalyst support member as defined in claim 1 wherein said catalyst carrier metal oxide powder is aluminum oxide powder and said strength maintaining metal oxide powder is aluminum oxide powder.

4. The catalyst support member as defined in claim 1, 2 or 3 wherein the catalyst carrier metal oxide powder is an aluminum oxide powder having an average diameter ranging from 0.05–1 $\mu$m and a specific surface area of 8 $m^2/g$ or more.

5. The catalyst support member as defined in claim 1 or 2 wherein the strength maintaining metal oxide powder is a titanium oxide powder having an average diameter of not more than 0.8 $\mu$m.

6. The catalyst support member as defined in claim 4 wherein the strength maintaining metal oxide powder is a titanium oxide powder having an average diameter of not more than 0.8 $\mu$m.

7. The catalyst support member as defined in claim 1 or 3 wherein the strength maintaining metal oxide powder is an aluminum oxide powder having an average diameter of not more than 0.2 $\mu$m.

8. The catalyst support member as defined in claim 4 wherein the strength maintaining metal oxide powder is an aluminum oxide powder having an average diameter of not more than 0.2 $\mu$m.

* * * * *